US005454060A

United States Patent [19]

McDermott

[11] Patent Number: 5,454,060

[45] Date of Patent: Sep. 26, 1995

[54] FOOT DRYER

[76] Inventor: Neal J. McDermott, 112 Corbett, Epworth, Iowa 52045

[21] Appl. No.: 285,085

[22] Filed: Aug. 3, 1994

[51] Int. Cl.[6] ..... F26B 19/00

[52] U.S. Cl. ..... 392/383; 34/202; 34/90; 34/91

[58] Field of Search ..... 34/90, 91, 202; 392/383

[56] References Cited

U.S. PATENT DOCUMENTS 1,658,489 2/1928 Lindstrom .
3,683,896 8/1972 Peplin .

*Primary Examiner*—Henry A. Bennet
*Assistant Examiner*—Siddharth Ohri

[57] ABSTRACT

A new and improved foot dryer comprised of a housing. A securement spring is secured within the housing. The securement spring has an end portion extending outwardly of the housing. An intake vent is secured within the housing. A pair of vents are secured within the housing. The housing functions to be installed within the floor of a bathroom. A pressure activated limit switch is secured within the housing opposite the intake vent. The pressure activated limit switch has a pressure rod secured to the limit switch and extending out of the container. A timer is electrically secured to the pressure activated limit switch. The timer has a thirty second limit. A heating element is secured within the housing. A wire electrically secures the heating element to the timer. A fan is secured to the intake vent of the housing. A wire is electrically secured to the fan and to the timer. A screened cover is springably secured to the pressure rod of the pressure activated limit switch and to the securement spring of the housing.

2 Claims, 4 Drawing Sheets

FIG 5
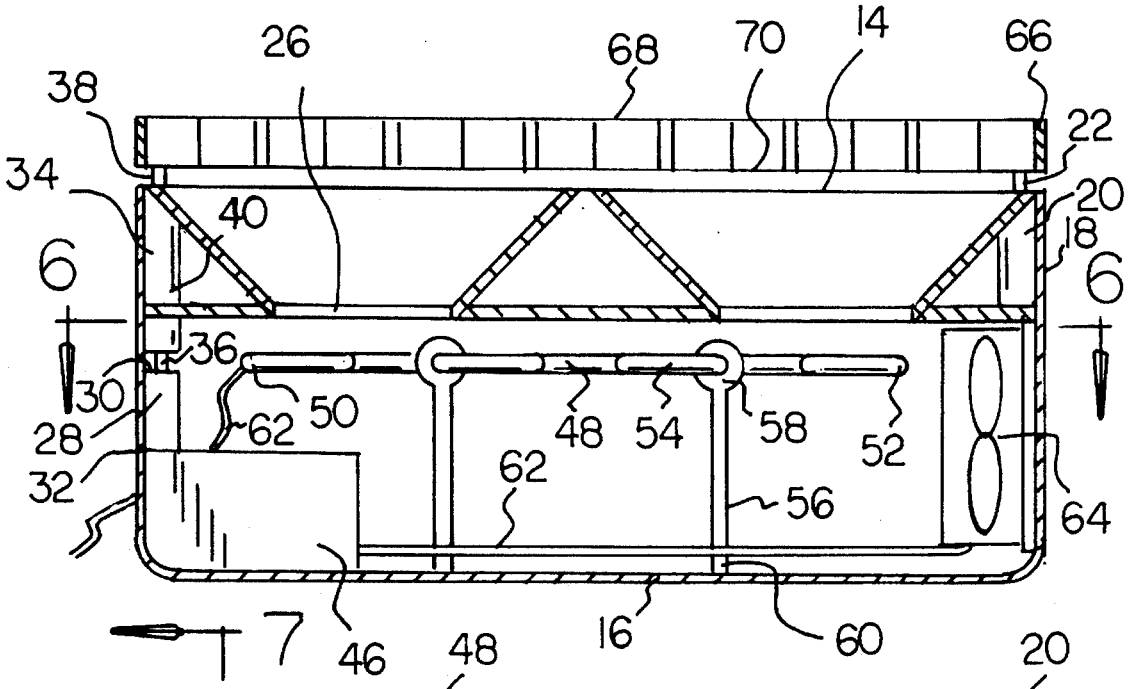
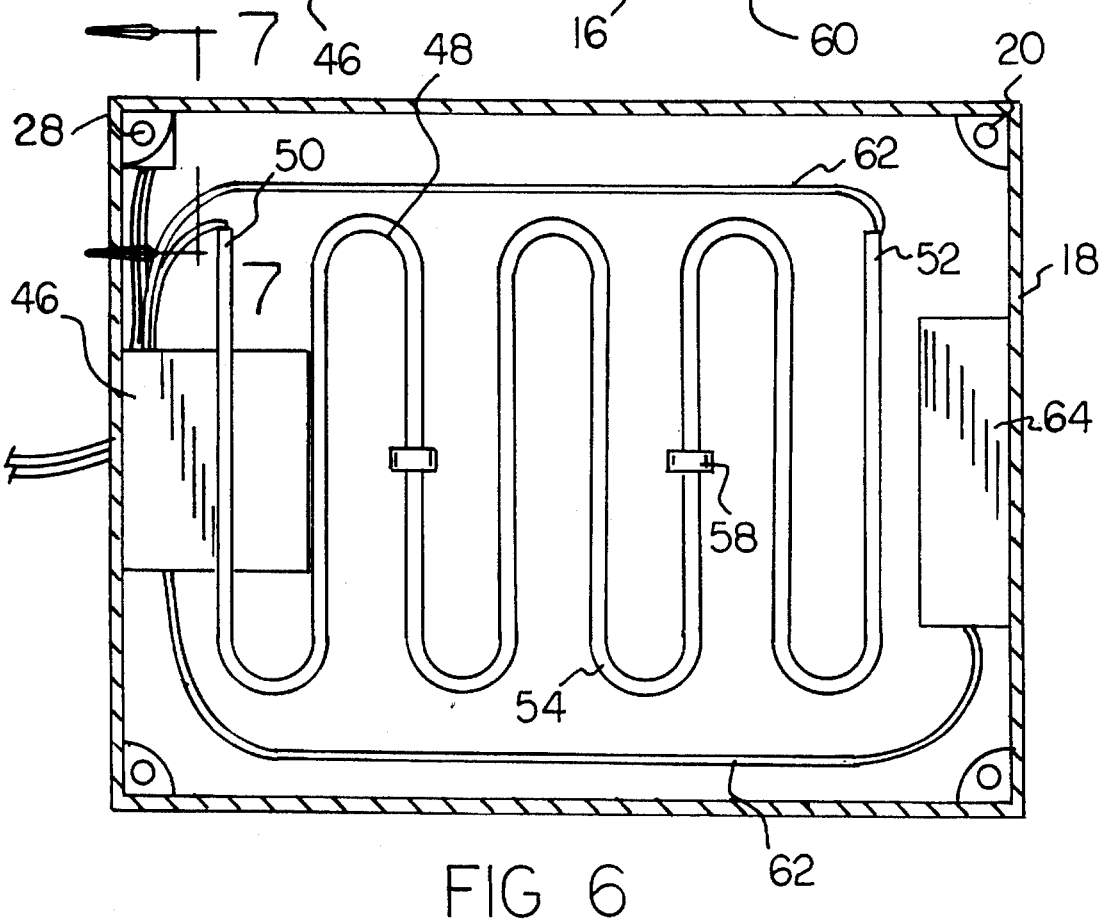
FIG 6

FOOT DRYER

BACKGROUND OF THE INVENTION

1. Field of the Invention

The present invention relates to a foot dryer and more particularly pertains to providing a heater which is installed in the floor of a bathroom to enable a users feet to be thoroughly dried with a foot dryer.

2. Description of the Prior Art

The use of foot drying apparatuses is known in the prior art. More specifically, foot drying apparatuses heretofore devised and utilized for the purpose of drying feet are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,683,896 to Peplin discloses a vibrating foot drying and treating apparatus.

U.S. Pat. No. 3,943,922 to Umeda discloses a drying appliance for preventing athlete's foot.

U.S. Pat. No. 5,249,367 to Nafziger discloses a nail drying apparatus and method therefor.

U.S. Pat. No. 3,865,122 to Dabbs discloses a foot drying apparatus.

U.S. Pat. No. 4,782,601 to Gonzalez discloses a foot drying assembly.

While these devices fulfill their respective, particular objective and requirements, the aforementioned patents do not describe a foot dryer that provides a heater which is installed in the floor of a bathroom to enable a users feet to be thoroughly dried.

In this respect, the foot dryer according to the present invention substantially departs from the conventional concepts and designs of the prior art, and in doing so provides an apparatus primarily developed for the purpose of providing a heater which is installed in the floor of a bathroom to enable a users feet to be thoroughly dried.

Therefore, it can be appreciated that there exists a continuing need for a new and improved foot dryer which can be used for providing a heater which is installed in the floor of a bathroom to enable a users feet to be thoroughly dried. In this regard, the present invention substantially fulfills this need.

SUMMARY OF THE INVENTION

In the view of the foregoing disadvantages inherent in the known types of foot drying apparatuses now present in the prior art, the present invention provides an improved foot dryer. As such, the general purpose of the present invention, which will be described subsequently in greater detail, is to provide a new and improved foot dryer and method which has all the advantages of the prior art and none of the disadvantages.

To attain this, the present invention essentially comprises a rectangular housing having an open top, a closed bottom, a front wall, a back wall, two sidewalls, an inner surface, and an outer surface. A securement spring is secured to the inner surface of one of the two sidewalls. The securement spring has an end portion that extends outwardly of the open top. An intake vent is secured within one of the two sidewalls. A pair of vents are secured to the inner surface inward of the open top. The rectangular housing functions to be installed within the floor of a bathroom. The device contains a pressure activated limit switch that is secured to the inner surface of one of the two sidewalls opposite the intake vent of the rectangular housing. The pressure activated limit switch has a top side and a lower side. The pressure activated limit switch has a pressure rod having a first end, a second end, and an intermediate extent therebetween. The first end is secured to the top side of the limit switch. The second end extends outwardly of the open top of the rectangular container. The second end corresponds to the end portion of the securement spring on the other of the two sidewalls. The intermediate extent has a spring and a shoulder activator therein. A timer is electrically secured to the lower side of the pressure activated limit switch. The timer has a thirty second limit. The device contains a heating element having a first end, a second end, and an intermediate extent therebetween. Two securement poles have a first end and a second end. The first end is secured to the intermediate extent of the heating element. The second end is secured to the inner surface of the closed bottom of the rectangular housing. A wire electrically secures the first end and the second end of the heating element to the timer. A fan is secured to the inner surface of one of the two sidewalls inward of the intake vent of the rectangular housing. A wire is electrically secured to the fan and to the timer. The device contains a screened cover having an upper surface and a lower surface. The lower surface is springably secured to the second end of the pressure rod of the pressure activated limit switch and to the end portion of the securement spring of the rectangular housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foot dryer which has all the advantages of the prior art foot drying apparatuses and none of the disadvantages.

It is another object of the present invention to provide a new and improved foot dryer which may be easily and efficiently manufactured and marketed.

It is a further object of the present invention to provide a new and improved foot dryer which is of durable and reliable construction.

An even further object of the present invention is to provide a new and improved foot dryer which is susceptible of a low cost of manufacture with regard to both materials and labor, and which accordingly is then susceptible of low prices of sale to the consuming public, thereby making such a foot dryer economically available to the buying public.

Still yet another object of the present invention is to provide a new and improved foot dryer which provides in the apparatuses and methods of the prior art some of the advantages thereof, while simultaneously overcoming some of the disadvantages normally associated therewith.

Even still another object of the present invention is to provide a new and improved foot dryer for providing a heater which is installed in the floor of a bathroom to enable a users feet to be thoroughly dried.

Lastly, it is an object of the present invention to provide a new and improved foot dryer comprised of a housing. A securement spring is secured within the housing. The securement spring has an end portion extending outwardly of the housing. An intake vent is secured within the housing. A pair of vents are secured within the housing. The housing functions to be installed within the floor of a bathroom. A pressure activated limit switch is secured within the housing opposite the intake vent. The pressure activated limit switch has a pressure rod secured to the limit switch and extending out of the container. A timer is electrically secured to the pressure activated limit switch. The timer has a thirty second limit. A heating element is secured within the housing. A wire electrically secures the heating element to the timer. A fan is secured to the intake vent of the housing. A wire is electrically secured to the fan and to the timer. A screened cover is springably secured to the pressure rod of the pressure activated limit switch and to the securement spring of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view taken along line 5—5 of FIG. 4.

FIG. 6 is a cross-sectional view taken along line 6—6 of FIG. 5.

The same reference numerals refer to the same parts through the various Figures.

DESCRIPTION OF THE PREFERRED EMBODIMENT

Figure 1:
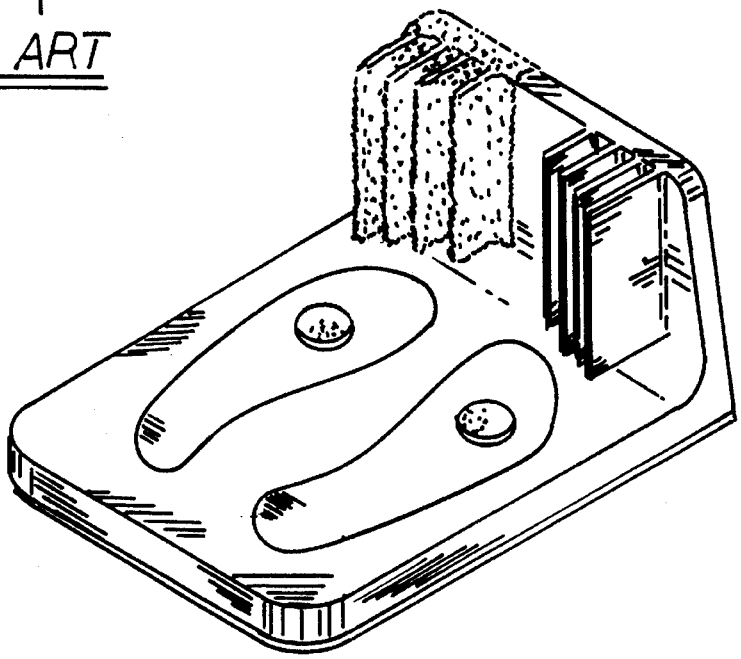
FIG 1 PRIOR ART
FIG. 1 is a perspective view of the prior art foot drying apparatus.
Figure 2:
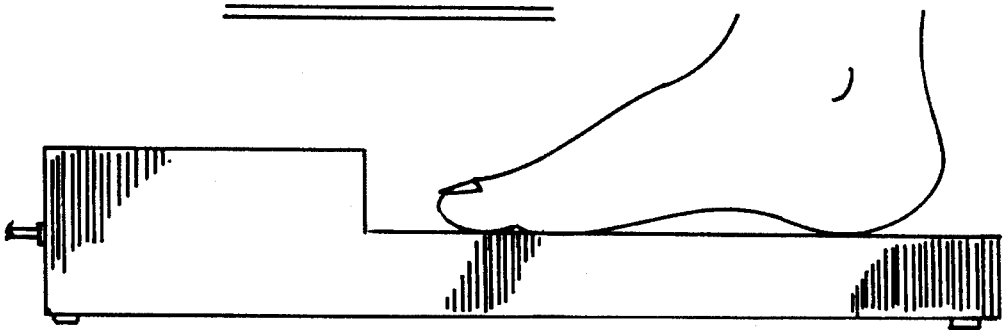
FIG 2 PRIOR ART
FIG. 2 is a side plan view of the prior art foot drying assembly.
Figure 3:
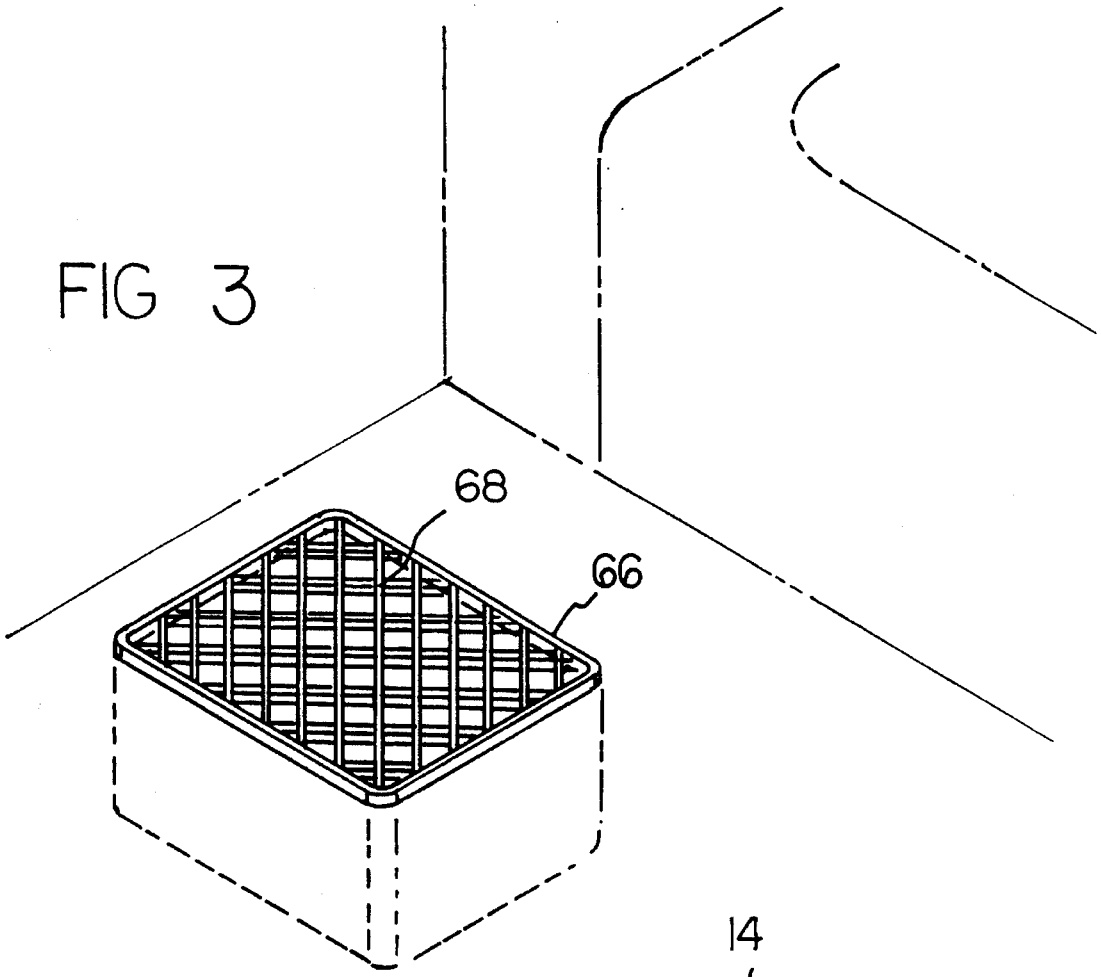
FIG. 3 is a perspective view of the present invention illustrated as imbedded in the floor.
Figure 4:
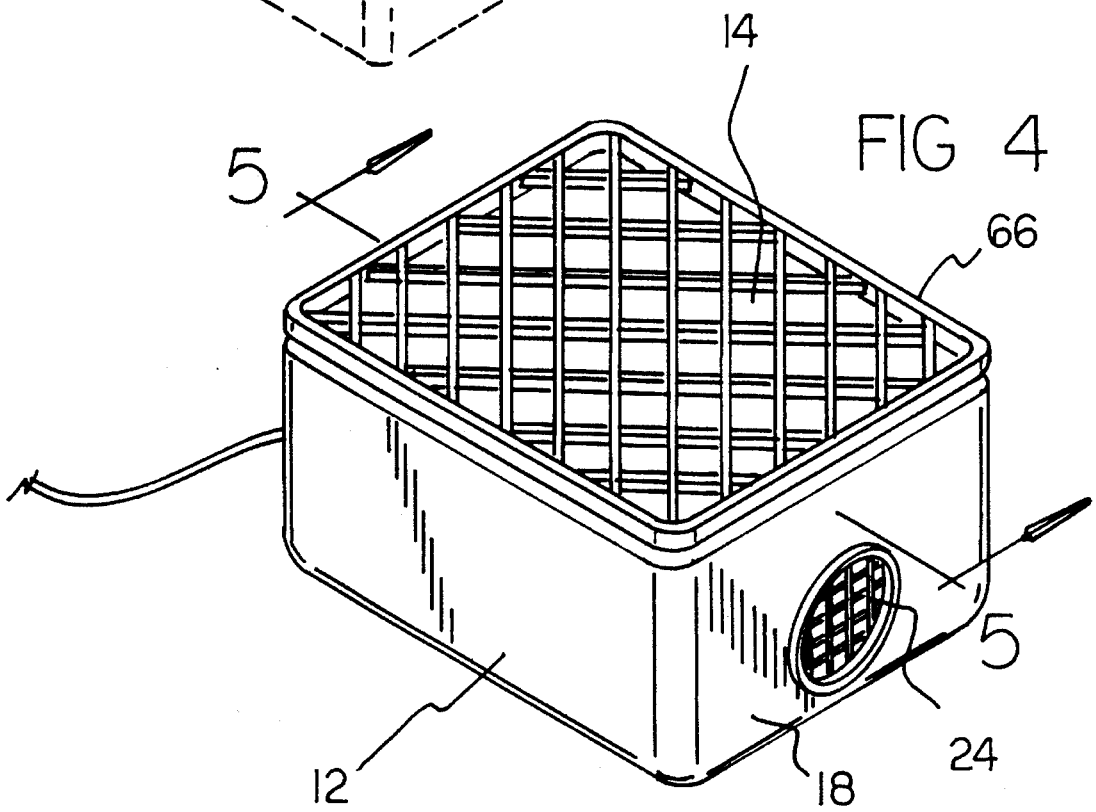
FIG. 4 is a perspective view of the preferred embodiment of the foot dryer constructed in accordance with the principles of the present invention.
Figure 7:
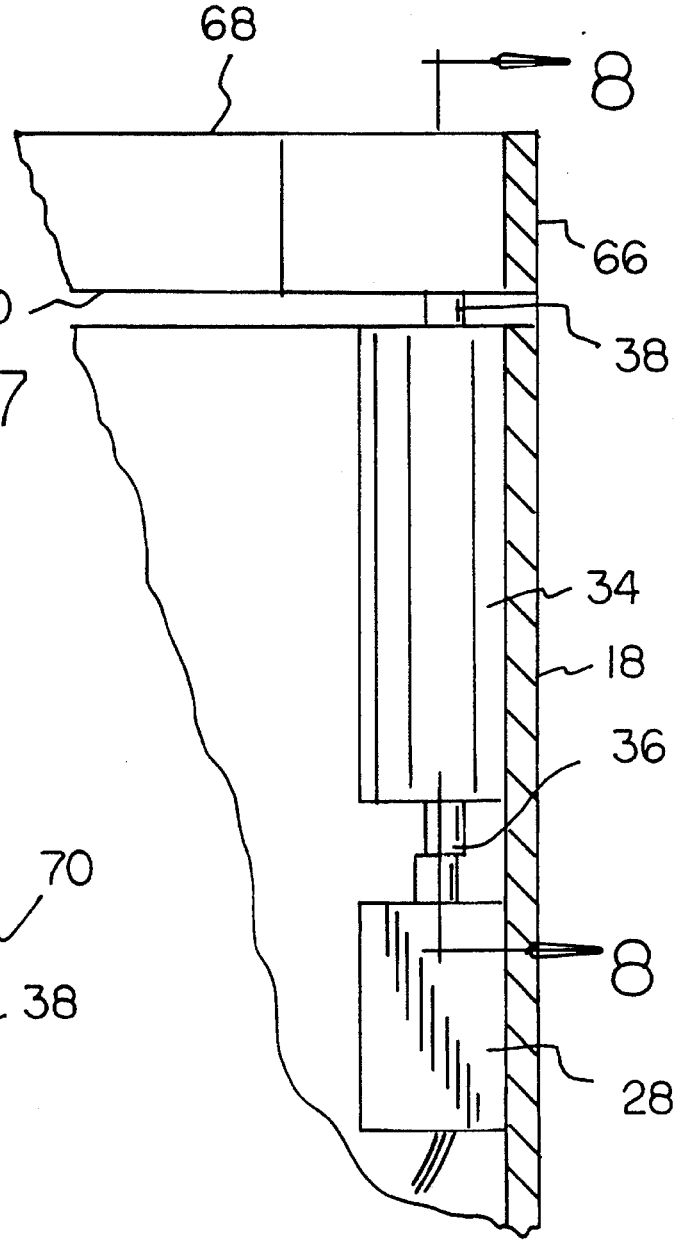
FIG. 7 is a cross-sectional view taken along line 7—7 of FIG. 6.
Figure 8:
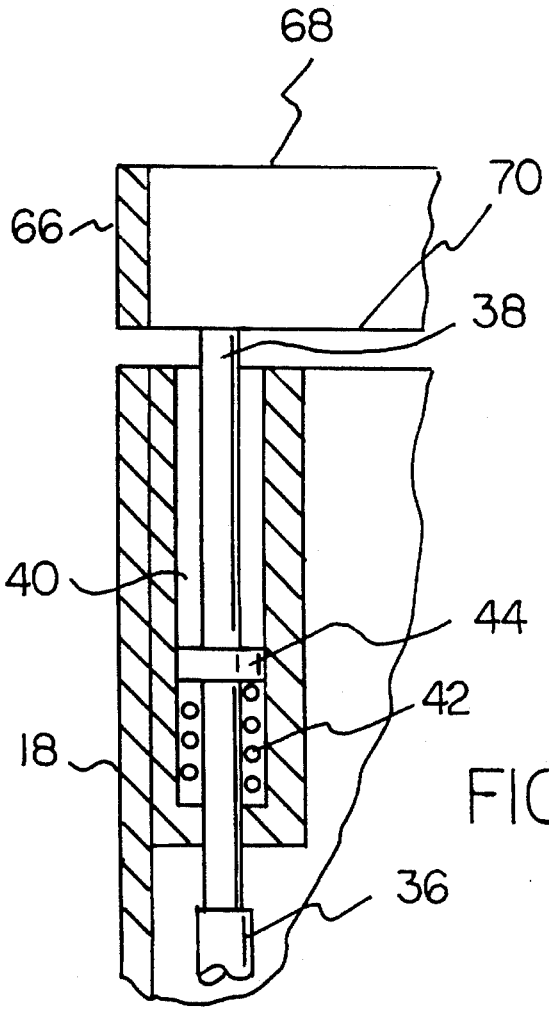
FIG. 8 is a cross-sectional view taken along line 8—8 of FIG. 7.

With reference now to the drawings, and in particular, to FIG. 1 thereof, the preferred embodiment of the new and improved foot dryer embodying the principles and concepts of the present invention and generally designated by the reference number 10 will be described.

Specifically, it will be noted in the various Figures that the device relates to a new and improved foot dryer for providing a heater which is installed in the floor of a bathroom to enable a users feet to be thoroughly dried. In its broadest context, the device consists of a rectangular housing, a pressure activated limit switch, a timer, a heating element, a fan, and a screened cover.

The device 10 contains a rectangular housing 12 having an open top 14, a closed bottom 16, a front wall, a back wall, two sidewalls 18, an inner surface, and an outer surface. A securement spring 20 is secured to the inner surface of one of the two sidewalls 18. The securement spring 20 has an end portion 22 that extends outwardly of the open top 14. An intake vent 24 is secured within one of the two sidewalls 18. A pair of vents 26 are secured to the inner surface inward of the open top 14. The rectangular housing 12 functions to be installed within the floor of a bathroom.

The device 10 contains a pressure activated limit switch 28 that is secured to the inner surface of one of the two sidewalls 18 opposite the intake vent 24 of the rectangular housing 12. The pressure activated limit switch 28 has a top side 30 and a lower side 32. The pressure activated limit switch 28 has a pressure rod 34 having a first end 36, a second end 38, and an intermediate extent 40 therebetween. The first end 36 is secured to the top side of 30 the limit switch 28. The second end 38 extends outwardly of the open top 14 of the rectangular container 12. The second end 38 corresponds to the end portion 22 of the securement spring 20 on the other of the two sidewalls 18. The intermediate extent 40 has a spring 42 and a shoulder activator 44 therein. The spring 42 and shoulder activator 44 serve to activate the device when pressure is placed on end portion 22 and the second end 38 of the pressure rod.

A timer 46 is electrically secured to the lower side 32 of the pressure activated limit switch 28. The timer 46 has a thirty second limit. The timer 46 is triggered once pressure has been placed on the end portion 22 of the securement spring 20 to force the shoulder activator 44 down onto the pressure activated limit switch 28. The 46 timer resets itself after the thirty seconds expire. The timer 46 is not limited to thirty seconds. It can be adjusted to the length of time suited to a particular user.

The device 10 contains a heating element 48 having a first end 50, a second end 52, and an intermediate extent 54 therebetween. Two securement poles 56 have a first end 58 and a second end 60. The first end 58 is secured to the intermediate extent 54 of the heating element 48. The second end 60 is secured to the inner surface of the closed bottom 16 of the rectangular housing 14. A wire 62 electrically secures the first end 50 and the second end 52 of the heating element 48 to the timer 46. The heating element 48 activates after the timer 46 is activated and produces instant heat that serves to dry a users feet.

A fan 64 is secured to the inner surface of one of the two sidewalls 18 inward of the intake vent 24 of the rectangular housing 12. A wire 62 is electrically secured to the fan 64 and to the timer 46. The fan 64 is activated when the timer 46 is activated. The fan 64 serves to blow the hot air generated by the heating element 48 through the vents 26 and through the screened cover onto the users feet.

The device 10 contains a screened cover 66 having an upper surface 68 and a lower surface 70. The lower surface 70 is springably secured to the second end 38 of the pressure rod 34 of the pressure activated limit switch 28 and to the end portion 22 of the securement spring 20 of the rectangular housing 12. The device is activated upon a user standing on the upper surface 68 applying at least twenty-five pounds of pressure. When the timer 46 shuts off after thirty seconds, the user simply steps off of the screened cover 66 and then steps back on to reactivate the device 10.

The present invention provides the luxurious benefits of a heater which is installed in the floor of a bathroom to enable the feet to be thoroughly dried. It will dry the underside of the foot, including the toes, in a manner which is far superior to that achieved by wiping with a towel. In that regard, it is likely that it will greatly decrease the potential for developing the fungus infection which is commonly called "athlete's foot." This fungus flourishes in damp dark areas, commonly found in shoes, combined with the perspiration from toes. Sunlight and dryness are enemies of the fungus. This product will ensure that the feet are completely dried after showering and bathing.

The heater is operated electrically, in the same manner as a blow dryer. It is housed in a rectangular frame, which is 16" by 14" in size, and made of metal. The outlet is divided into two sections, with the air discharged through thick screens made of high strength plastic. When a weight of 25 pounds or more is placed on the outlet, the unit is turned on automatically, heating the elements and turning on an air blower. It operates for thirty seconds, then shuts off. To restart the present invention, the person steps off of the unit, then steps back on it again.

The present invention has a fan located directly under the heating elements and diffusers are provided to ensure good distribution of the air. All homeowners should appreciate this delightful convenience.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A foot dryer for providing a heater which is installed in the floor of a bathroom to enable a users feet to be thoroughly dried comprising, in combination:

a rectangular housing having an open top, a closed bottom, a front wall, a back wall, two sidewalls, an inner surface, and an outer surface, a securement spring secured to the inner surface of one of the two sidewalls, the securement spring having an end portion extending outwardly of the open top, an intake vent secured within one of the two sidewalls, a pair of vents secured to the inner surface inward of the open top, the rectangular housing functioning to be installed within the floor of a bathroom;

a pressure activated limit switch secured to the inner surface of one of the two sidewalls opposite the intake vent of the rectangular housing, the pressure activated limit switch having a top side and a lower side, the pressure activated limit switch having a pressure rod having a first end, a second end, and an intermediate extent therebetween, the first end secured to the top side of the limit switch, the second end extending outwardly of the open top of the rectangular container, the second end corresponding to the end portion of the securement spring on the other of the two sidewalls, the intermediate extent having a spring and a shoulder activator therein;

a timer electrically secured to the lower side of the pressure activated limit switch, the timer having a thirty second limit;

a heating element having a first end, a second end, and an intermediate extent therebetween, two securement poles having a first end and a second end, the first end secured to the intermediate extent of the heating element, the second end secured to the inner surface of the closed bottom of the rectangular housing, the heating element extending horizontally along the closed bottom of the housing, a wire electrically securing the first end and the second end of the heating element to the timer;

a fan secured to the inner surface of one of the two sidewalls inward of the intake vent of the rectangular housing, a wire electrically secured to the fan and to the timer;

a screened cover having an upper surface and a lower surface, the lower surface springably secured to the second end of the pressure rod of the pressure activated limit switch and to the end portion of the securement spring of the rectangular housing.

2. A foot dryer comprising, in combination:

a housing, a securement spring secured within the housing, the securement spring having an end portion extending outwardly, an intake vent secured within the housing, a pair of vents secured within the housing, the housing functioning to be installed within the floor of a bathroom;

a pressure activated limit switch secured within the housing opposite the intake vent, the pressure activated limit switch having a pressure rod secured to the limit switch extending outwardly of the container;

a timer electrically secured to the pressure activated limit switch, the timer having a thirty second limit;

a heating element secured to the housing, a wire electrically securing the heating element to the timer, the heating element extending horizontally along the closed bottom of the housing;

a fan secured to the intake vent of the housing, a wire electrically secured to the fan and to the timer;

a screened cover springably secured to the pressure rod of the pressure activated limit switch and to the securement spring of the housing.

* * * * *